United States Patent [19]

Vlahos

[11] Patent Number: 4,543,680

[45] Date of Patent: Oct. 1, 1985

[54] BLACKBOARD ERASER HANDLE

[76] Inventor: Stephanie A. Vlahos, 3517 Winway, San Mateo, Calif. 94403

[21] Appl. No.: 571,810

[22] Filed: Jan. 18, 1984

[51] Int. Cl.[4] ..... A47L 13/16

[52] U.S. Cl. ..... 15/145; 15/209 R; 16/114 R; 294/29

[58] Field of Search ..... 15/145, 146, 209 R, 15/210 R, 210.5, 219, 220 R, 224, 244 R, 425, 426, 105.5, 192, 221, 202, 223; 51/205 R; 16/114 R, DIG. 25; 294/29, 33

[56] References Cited

U.S. PATENT DOCUMENTS

| | | | |
|---|---|---|---|
| Re. 4,529 | 8/1871 | Charles | 15/209 R |
| D. 109,944 | 5/1938 | Daust | 15/210 R |
| 122,511 | 1/1872 | Bigger et al. | 15/221 |
| 144,674 | 11/1873 | Horton | 15/209 R |
| 1,079,672 | 11/1913 | Simpson | 15/209 R |
| 2,155,462 | 4/1939 | Anderson | 15/145 X |
| 2,203,195 | 6/1940 | Gillespie | 15/223 UX |
| 2,249,912 | 7/1941 | Oxley | 15/244 R |
| 2,648,863 | 8/1953 | Darling | 15/146 X |
| 2,842,791 | 7/1958 | Statler | 15/209 R |
| 2,975,453 | 3/1961 | Imhof | 15/244 R X |
| 3,444,579 | 3/1969 | Thomford | 15/210 R X |
| 3,656,201 | 4/1972 | Alcocer | 15/118 |
| 3,747,152 | 7/1973 | Tsuruzawa | 15/221 X |
| 3,748,684 | 7/1973 | Fraser | 15/244 R |
| 3,864,778 | 2/1975 | Vopat et al. | 15/105 |
| 4,007,509 | 2/1977 | Odhner | 15/159 A |
| 4,104,759 | 8/1978 | Odhner | 15/224 X |
| 4,232,420 | 11/1980 | Schuster et al. | 15/209 D |
| 4,244,075 | 1/1981 | Silver | 15/145 |
| 4,300,258 | 11/1981 | Burns et al. | 15/210 R |

FOREIGN PATENT DOCUMENTS

| | | | |
|---|---|---|---|
| 1389418 | 4/1975 | United Kingdom | 15/221 |
| 1405845 | 9/1975 | United Kingdom | 15/209 R |

*Primary Examiner*—Philip R. Coe
*Assistant Examiner*—Frankie L. Stinson
*Attorney, Agent, or Firm*—David B. Harrison

[57] ABSTRACT

A detachable handle for use on erasers having absorbent material attached to a flat, rigid backing plate such as the common blackboard eraser. A "C" shaped rigid strap contains "C" shaped notches in the ends thereof. These notches are disposed to face one another and to engage opposite edges of the eraser backing plate. The notches are sized to frictionally retain the backing plate thereby providing a handle to control the eraser during use.

14 Claims, 7 Drawing Figures

BLACKBOARD ERASER HANDLE

BACKGROUND OF THE INVENTION

This invention relates to detachable handles and in particular to detachable handles used on blackboard chalk erasers.

Blackboard erasers are well known in the art. The typical eraser consists of rectangular strips of felt material having their edges bonded to a backing plate.

The backing plate is formed of thin, rigid material of a rectangular shape and the unbonded edges of the adjacent felt strips extend perpendicular from the backing plate. The user holds the backing plate and wipes the unbound edges of the felt strips across the blackboard to erase previous writing. The strips retain the chalk dust until subsequently cleaned by tapping or pounding the eraser against a firm surface. Many improvements have been made to the blackboard eraser with the object of retaining more chalk dust and thereby increasing the time between cleanings.

U.S. Pat. No. 4,007,509 to Odhner utilized rows of fiberglass filaments as a substitute for the felt strips. The filament rows were attached to a backing plate in a manner leaving gaps between the filament rows. These gaps or channels retained the chalk dust until cleaning.

U.S. Pat. No. 3,864,778 to Vopat, et al. comprised a unitary backing plate and erasing surface. This unitary eraser was formed by cutting a thermo plastic foam with a hot wire which sealed the surface pores of the foam. Subsequent abrading of the erasing surface opened chalk dust retaining pores.

U.S. Pat. No. 3,748,684 to Fraser used a nonreticulating, flexible polyester urethane foam with specific pore size to increase eraser chalk dust retention characteristics. This material was glued to a flat, channel shaped backing plate.

Not withstanding these improvements, the felt type eraser is by far the most prevalent chalkboard eraser. However, a number of problems characterize the use of this type of eraser.

To retain the form of the eraser, the length which the felt strips extend from the backing plate must be limited. Consequently, the user's hand which is gripping the backing plate is in close proximity to the blackboard during erasing. Chalk dust which is not retained by the eraser is deposited on the user's hand and is soon transferred to the user's clothing.

The proximity of the user's hand to the blackboard has another major drawback. The user's fingernails may come in contact with the blackboard during eraser movement. This contact results in a familiar and extremely objectional piercing screech being emitted as the fingernails scrape along the blackboard surface. In addition, painful injury to the fingernails and hands may result.

Yet another objectional feature of the common felt type eraser is its tendency to trip during use. When considerable pressure is applied to the eraser while wiping the blackboard, a substantial friction is developed between the eraser and the blackboard. This friction occurs where the eraser surface contacts the blackboard and results in a force on the eraser resisting the wiping movement. Concurrently, a force in the direction of wiping is applied by the user at the backing plate which is a short distance from the blackboard. These forces combine to rotate the eraser around its leading edge causing it to flip out of the user's grasp with considerable force. This action spreads retained chalk dust throughout the vicinity and on the user's clothes. In addition, the sudden tripping action can cause injury to the user's hand should it strike the blackboard.

SUMMARY OF THE INVENTION WITH OBJECTS

One object of this invention is to provide a handle for the common blackboard eraser which maintains a sufficient distance between the user's hand and the blackboard to prevent accumulation of chalk dust on the user's hand.

Another object of this invention is to prevent contact of the eraser user's fingernails with the blackboard and the resulting objectionable sound and possible injury to the user.

One more object of this invention is to provide positive control over the eraser during use and to prevent tripping by counteracting the turning movement caused by friction and the driving force exerted by the user.

Yet another object of this invention is to provide a detachable handle which mounts on the common type eraser and accomplishes the above objects without requiring modification of the eraser.

These and other objects are accomplished by a flat, rigid "C" shaped strap having two "C" shaped notches in the ends thereof disposed to face one another for clamping engagement with opposite edges of the rigid backing strip on a common type eraser.

Other objects, advantages and features of the invention will be apparent to those skilled in the art from consideration of the following detailed description of a preferred embodiment presented in conjunction with the accompanying drawings.

DESCRIPTION OF A PREFERRED EMBODIMENT

Figure 1:
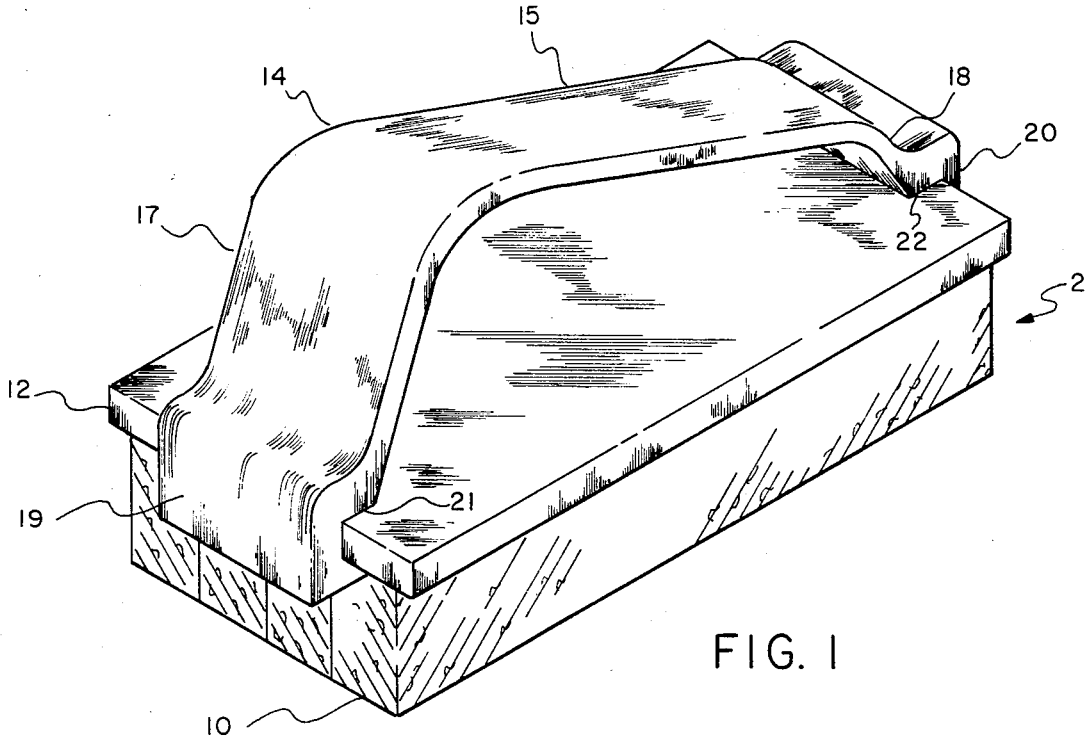
FIG. 1 is a perspective view of the eraser handle mounted on the typical felt type chalk eraser.

A blackboard eraser handle in accordance with the present invention is shown in FIG. 1 mounted to a typical felt type chalk eraser generally designated by reference numeral 2. The eraser 2 consists of felt strips 10 each having one edge adjacently attached to the underside of a flat, rigid backing plate 12. The felt strips 10 extend perpendicular to backing plate 12 so that the unattached edges provide a wiping surface. Although the invention is shown being used on a typical felt type chalk eraser, it is understood that the handle will perform equally well on any eraser having a thin, rigid backing plate. An example of another type eraser to which the handle will apply is a grease pen eraser used in conjunction with white boards.

The handle 14 comprises a "C" shaped rigid strap having an elevated central section 15 and depending sides 17, 18. The ends 19, 20 of depending sides 17, 18 are curved into a "C" shape thus forming notches 21, 22 which face each other. These notches 21, 22 engage the ends of backing plate 12 to attach the handle 14 to the eraser 2.

Figure 2:
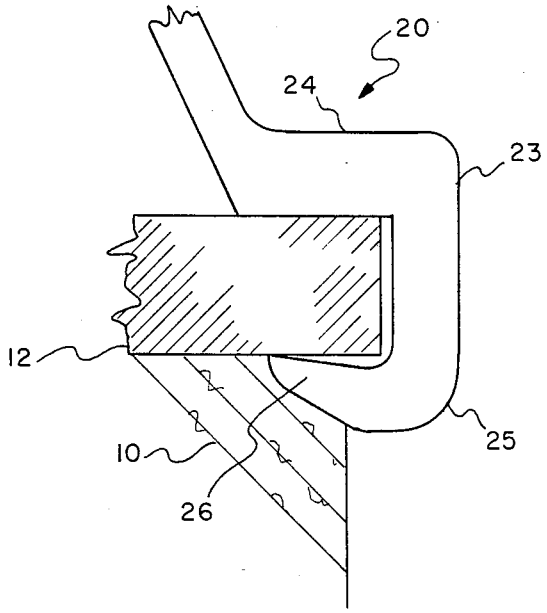
FIG. 2 is an enlarged section view of the handle notch used to clamp the handle to the eraser.

Referring now to FIG. 2, an enlarged elevation view of the "C" shaped end 20 is depicted. It is understood that end 19 is a mirror image of end 20 illustrated in FIG. 2. The "C" shaped end 20 consists of a vertical back section 23 connecting an upper horizontal section 24 and a lower horizontal section 25 thereby forming horizontal notch 22. The inside vertical dimension between upper and lower horizontal sections 24, 25 generally coincides with the thickness of eraser backing plate 12. The lower horizontal section 25 tapers to a point 26 as it extends away from vertical section 23 forming a relatively sharp lower edge of notch 22. The upper surface of lower horizontal section 25 is inclined upwardly slightly as it extends away from vertical section 23.

Thus when the notch 22 engages eraser backing plate 12 the lower horizontal section 25 is wedged between felt material 10 and backing plate 12. In addition, the inclined upper surface of lower horizontal section 25 frictionally holds the backing plate 12 against upper horizontal section 23. In this manner the edge of backing plate 12 is firmly held within notch 22.

Referring again to FIG. 1, the length of central handle section 15 is such that the distance between notches 21 and 22 is slightly less than the length of backing plate 12. When the handle is engaged on an eraser, the handle 14 yields slightly to become tensioned and notches 21, 22 are urged toward one another thus retaining the edges of backing plate 12 in notches 21, 22. The depending supports 17, 18 can be equal in length providing a central handle section 15 parallel to backing plate 12 or of unequal length providing an angle between central section 15 and base plate 12.

Figure 3:
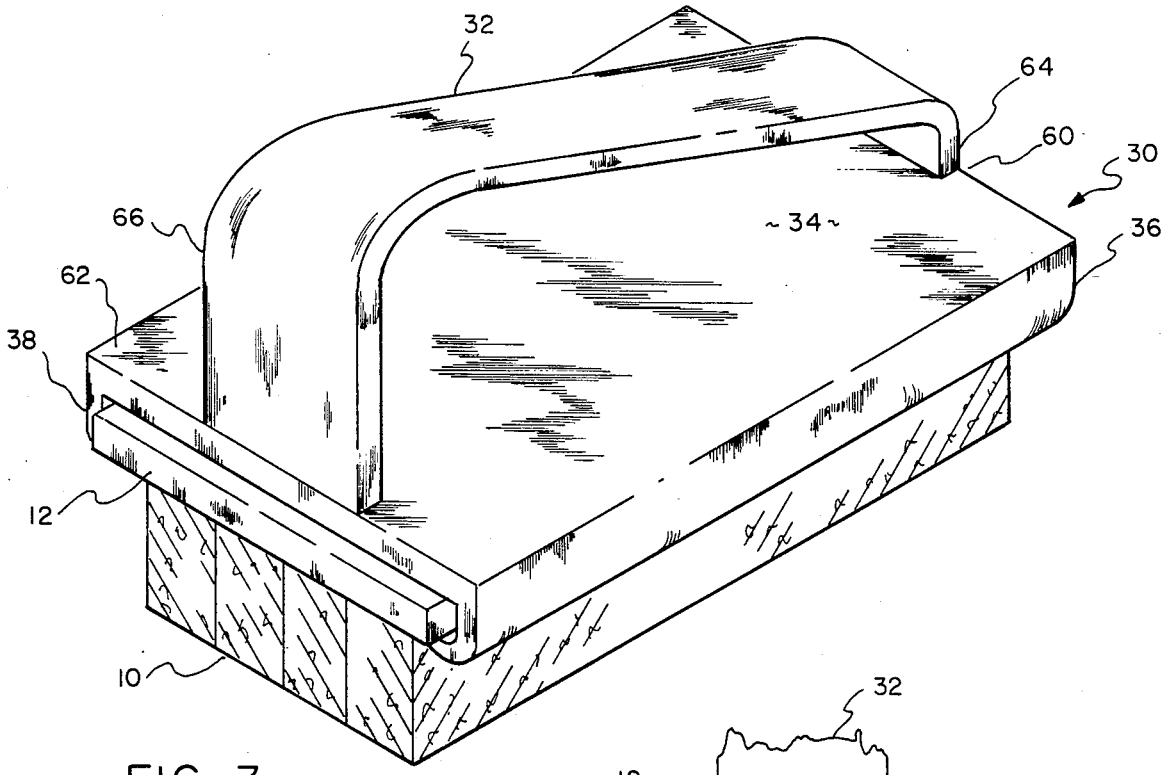
FIG. 3 is an alternate embodiment of a handle having a base plate with a common felt type eraser mounted in the handle.
Figure 4:
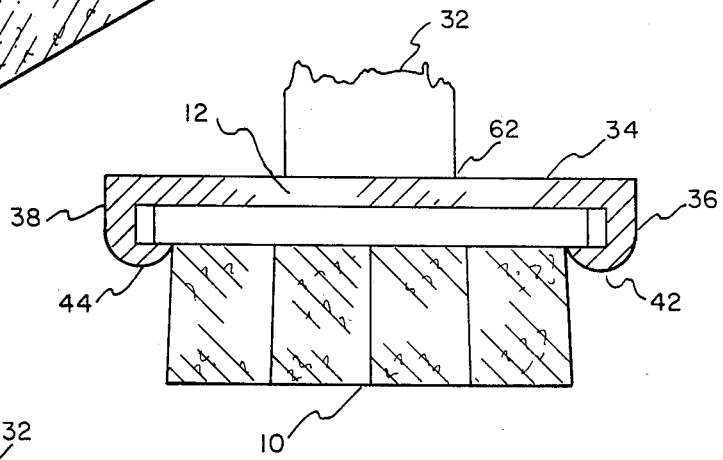
FIG. 4 is a partial front view of the eraser mounted in the holder.
Figure 5:
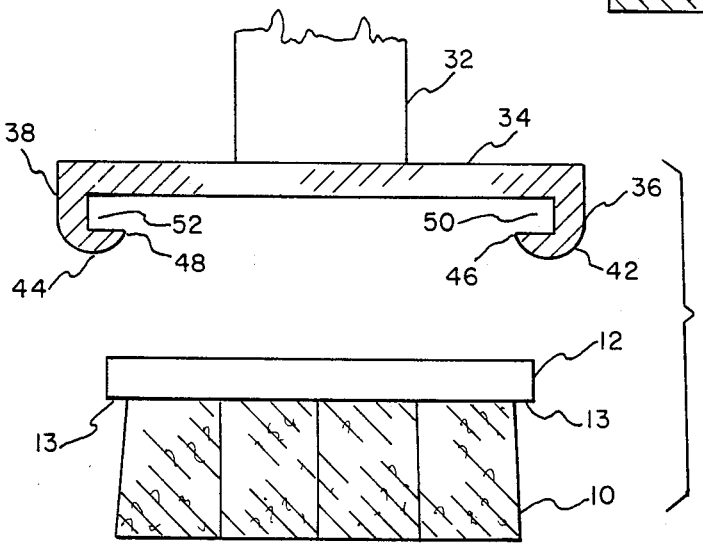
FIG. 5 is a partial front view of the eraser separated from the eraser holder.

Turning now to FIGS. 3–5 an alternate embodiment of the handle is depicted. This embodiment comprises a base generally designated by reference numeral 30 and a grip 32. The base includes a flat generally rectangular plate 34 having dimensions slightly larger than the backing plate 12 of the eraser. Depending from two opposite edges of the plate 32 are sides 36, 38. The distal ends 42, 44 of these depending sides 36, 38 are folded over toward each other to a position substantially parallel to plate 34 thereby forming ledges 46, 48. In this manner, the cross sections of the depending sides resemble "J" shapes facing each other and form notches 50, 52 between the depending sides 36, 38 and plate 34. The inside dimensions of notches 50, 52 represented by the distance between ledges 46, 48 and plate 34 are slightly less than the thickness of eraser backing plate 12. Typically, the width of eraser backing plate 12 is greater than the width of felt material 10 and therefore two lips 13 extend the length of the eraser under the backing plate 12 on either side of the felt material 10. The width of ledges 46, 48 generally coincide with the width of the lip 13 of the eraser backing plate 12.

Depending sides 36, 38 are depicted as continuous and as extending a length generally coinciding with the length of eraser backing plate 20. These sides need not be continuous. For instance, the middle portion of both depending sides 36, 38 could be alleviated without degrading the operation of the handle. In addition, the sides 36, 38 are shown depending from the two long edges of the rectangular plate 34. These long edges generally coincided with the long sides of the eraser backing plate 12. However, the handle also performs well if the depending sides 36, 38 depend from the short sides of plate 34 which coincide with the ends of the eraser backing plate 12.

The grip 32 is made of a flat, rigid strap. The end sections of the strap 64, 66 are bent down and attached to plate 34 at points 60, 62. The central section of the strap is thereby raised above plate 34 providing space for the user's hand to encircle comfortably the grip 32. As depicted, the end section 66 of the grip 32 is longer than end section 64. Consequently, the space between plate 34 and the central section of grip 32 decreases uniformly from one end of the holder to the other.

Figure 6:
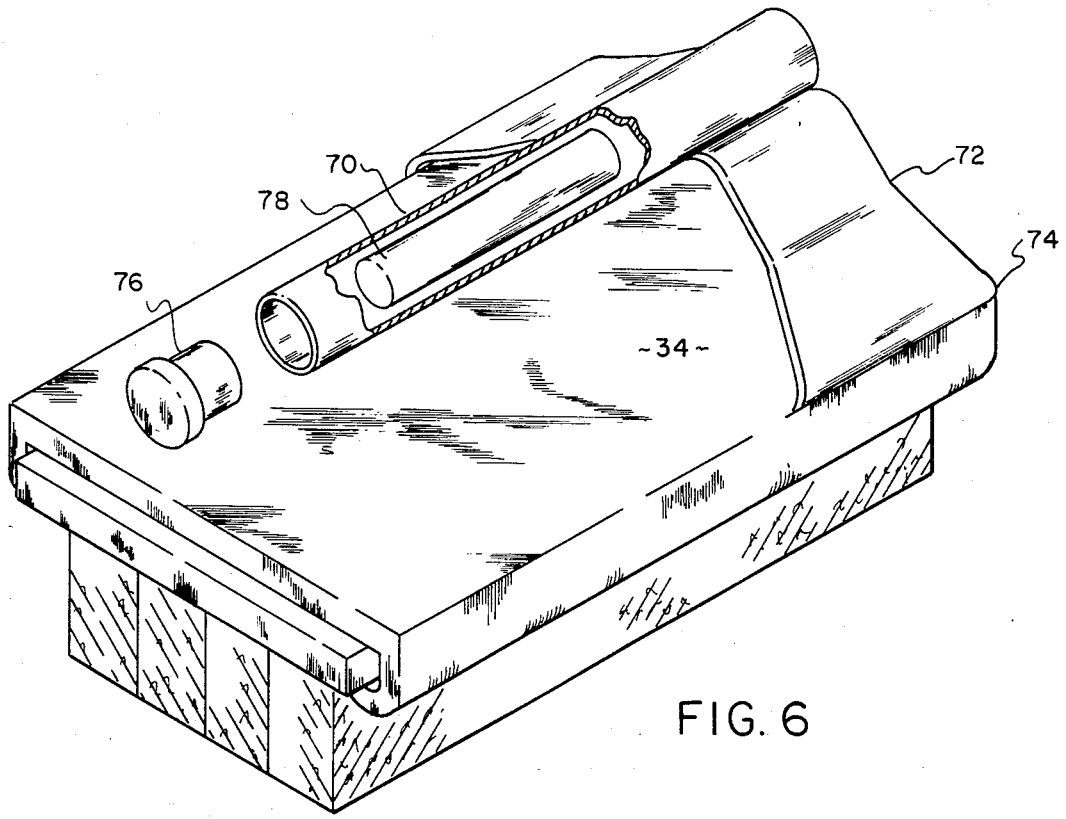
FIGS. 6 and 7 are perspective views of the blackboard eraser handle with alternate handle grip designs.
Figure 7:
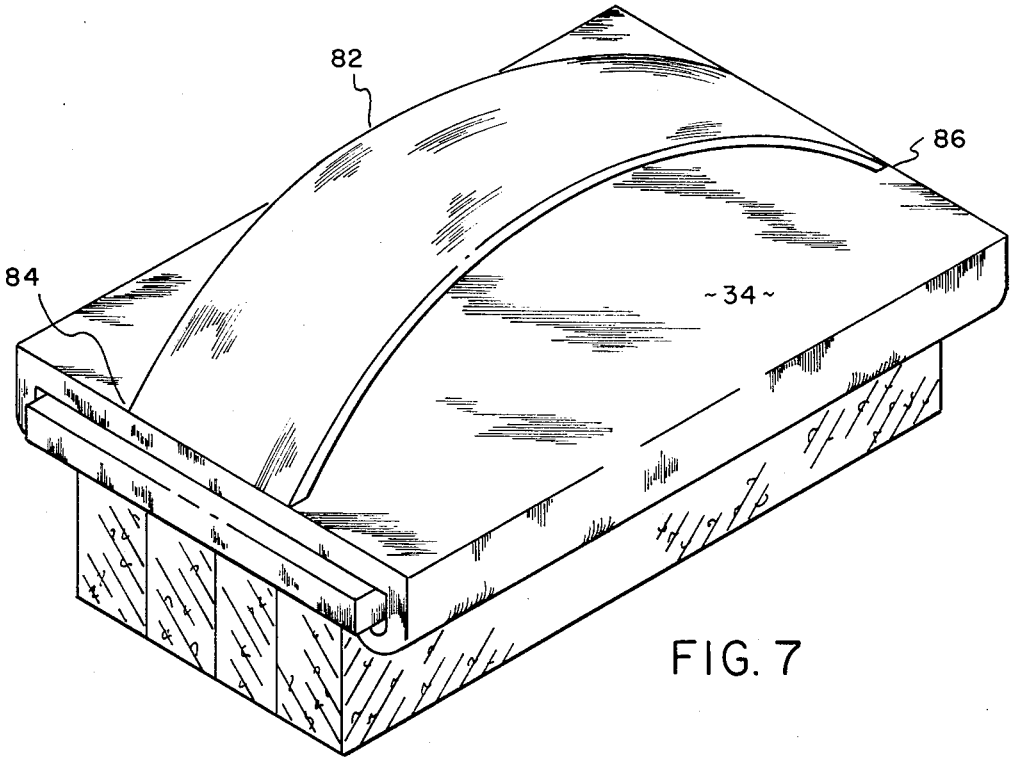

Referring now to FIGS. 6 and 7, two alternate grip designs are shown. In FIG. 6, the grip 70 is tubular in shape. One end 72 of grip 70 is bent downward and attached to plate 34 at point 74. The unattached end of grip 70 is fitted with a removable plug 76. The interior of grip 72 is hollow and functions as a storage space to hold chalk 78. The removable plug 76 retains the chalk in the grip and provides easy access for its removal or storage. FIG. 7 depicts another embodiment of the grip. Here, the grip 82 is formed from a rigid strap which is uniformly curved in the shape of an arch. The ends of grip 82 are fastened to plate 34 at points 84, 86 providing a grip which is symmetrical about the center of plate 34.

The embodiments described can be formed from any suitable material having sufficient rigidity and slight resilience such as metal, PVC, ABS or fiberglass reinforced plastic. To increase rigidity while retaining light weight characteristics, one or more perpendicular ridges may be formed along the back side of plate 34 and either the upper or lower side of grip 32.

To attach the handle depicted in FIG. 1 to an eraser the handle is held along side the eraser with notches 21, 22 in alignment with ends of backing plate 12. The handle is then slid sideways onto the backing plate until it aligns with the center of the backing plate and notches 21, 20 are firmly engaged on the ends of backing plate 12. To attach the handle described in FIGS. 3–7 the user holds the backing plate 20 of the eraser parallel to plate 34 so that one end of backing plate 20 aligns with notches 50, 52. The handle is then slid forward over the eraser backing plate 20 causing ledges 46, 48 to engage lips 13. The handle is slid further forward until plate 34 covers eraser backing plate 20. Friction between ledges 46, 48 and lips 13 retains the eraser in the handle during use. After the eraser is worn out, it can easily be replaced by sliding the handle off the old eraser and onto a new one.

To erase a blackboard, the user grasps the grip 15, 32, 72 or 82 and wipes the felt material 10 of the eraser across the blackboard. The handle maintains a sufficient distance from the board to the user's hand to prevent chalk dust from depositing on the user's hand and prevent contact between the user's fingernails and the blackboard during the wiping action. The rigid grip strap 15, 32 or 82 and the tubular grip 72 are formed with sufficient width to provide lateral control of the eraser by the user during the wiping action. The width of the grip 15, 32, 72 or 82 enables the user to impart a counter torque to the eraser to control and prevent tripping. Should the eraser trip due to excessive force normal to the blackboard during wiping, the user retains his grasp of the grip preventing the eraser from flying off and also protecting the user's hand. In the embodiment of the grips 15 and 32 having central sections tapering toward backing plate 12, the angle of taper is set by ergonometric considerations to provide a comfortable wrist angle during the wiping motion. In the embodiment of the grip 82 having a symmetrical arch shaped grip section, the eraser handle may be grasped from either end with the result of a comfortable grasp angle.

Having thus described the invention it will now be apparent that the objects of the invention have been fully achieved and it will be understood by those skilled in the art that many changes in construction and widely differing embodiments and applications of the invention will suggest themselves without departure from the spirit and scope of the invention. The disclosures and the description herein are purely illustrative and are not intended to be in any sense limiting.

I claim:

1. A detachable handle for an eraser having an absorbing material attached to a flat rigid rectangular backing plate having edgewalls of predetermined thickness and used to erase chalk or grease pen marks from black boards, white boards and the like, comprising a unitary, resiliently rigid structure having a predetermined transverse width and a predetermined longitudinal length related to the width and length of said backing plate, said structure including a "C" shaped strap in the longitudinal direction and having two "C" shaped notches along opposite edges thereof perpendicular to said longitudinal direction and disposed to face one another for overlying clamping engagement with opposite edgewalls of said rigid backing plate and wherein the untensioned longitudinal dimension between the interior endwalls of said notches is slightly less than the dimension of said backing plate between said engaged edgewalls thereof, said handle structure being under tension when engaged on said eraser.

2. A detachable handle for an eraser as described in claim 1 wherein the "C" shaped strap forms a symmetrical arch over said backing plate when engaged thereto.

3. A detachable handle for an eraser as described in claim 1 wherein the central section of said "C" shaped strap forms an angle with said backing plate to provide a comfortable grasp angle during use of said eraser.

4. A detachable handle for an eraser as described in claim 1 wherein each said "C" shaped notch comprises a vertical back section, an upper section adjoining and substantially perpendicular to said back section, and a lower section ajoining said back section wherein the distance between said upper section and said lower section generally corresponds to the thickness of the edgewall of said backing plate about which said "C" shaped notched portion may be clamped.

5. The detachable handle for an eraser as described in claim 4 wherein said lower section tapers away from said back section to form a relatively sharp lower edge and wherein the interior surface of said lower section is slightly undercut so that said lower edge engages the underside of said backing plate along the length of said notch.

6. The detachable handle for an eraser as described in claim 1 wherein said "C" shaped strap includes storage compartment means for providing a storage compartment for at least one marking implement for use in conjunction with said eraser.

7. The detachable handle for an eraser as described in claim 1 and formed of a material selected from the group including metal, rigidly resilient plastic such as PVC, ABS, and fiberglass reinforced plastic.

8. A detachable handle for an eraser having an absorbing material attached to a flat, rigid generally rectangular backing plate and used to erase chalk or grease pen marks from blackboards, white boards and the like comprising a unitary structure including a rigid base plate, a "C" shaped handle grip attached to the upper side of said base plate and clamping means for clamping the lower side of said base plate to said eraser backing plate, said clamping means comprising "J" shaped sides facing each other and depending from opposite edges of said base plate, said facing sides including interior opposed notches sized and spaced to receive opposite edgewalls of said base plate in overlying frictional clamping engagement therewith.

9. A detachable handle for an eraser as recited in claim 8 wherein the opposed interior faces of said notches formed in said "J" shaped sides facing each other are spaced apart slightly less than the thickness of said eraser backing plate at the edgewalls thereof, said notches thereby providing said frictional clamping engagement of said handle with said eraser backing plate.

10. A detachable handle for an eraser as recited in claim 8 wherein the handle grip further comprises a "C" shaped rigid strap with one or both ends connected to said base plate and its central section elevated above said base plate.

11. A detachable handle for an eraser as recited in claim 10 wherein said rigid strap forms a symmetrical arch over said base plate.

12. A detachable handle for chalkboard erasers as recited in claim 10 wherein one end of said central section is elevated higher than the other end so that said central section forms an ergonometrically comfortable angle with said base plate.

13. The detachable handle for an eraser as described in claim 8 wherein said handle grip includes storage compartment means for providing a storage compartment for at least one marking implement for use in conjunction with said eraser.

14. The detachable handle for an eraser as described in claim 8 and formed of a material selected from the group including metal, rigidly resilient plastic such as PVC, ABS and fiberglass reinforced plastic.

* * * * *